US010020613B2

(12) United States Patent
Lyon et al.

(10) Patent No.: US 10,020,613 B2
(45) Date of Patent: Jul. 10, 2018

(54) POWER TERMINAL FOR ARCLESS POWER CONNECTOR

(71) Applicant: TE CONNECTIVITY CORPORATION, Berwyn, PA (US)

(72) Inventors: Zachary Wood Lyon, Lewisville, NC (US); Jeremy Christian Patterson, Winston-Salem, NC (US); Abraham Louis Shocket, Cary, NC (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/661,751

(22) Filed: Jul. 27, 2017

(65) Prior Publication Data

US 2018/0034198 A1 Feb. 1, 2018

Related U.S. Application Data

(60) Provisional application No. 62/369,433, filed on Aug. 1, 2016.

(51) Int. Cl.
*H01R 13/53* (2006.01)
*H01R 13/66* (2006.01)
(Continued)

(52) U.S. Cl.
CPC ..... *H01R 13/53* (2013.01); *H01R 13/6616* (2013.01); *H01R 39/46* (2013.01); *H01R 39/54* (2013.01)

(58) Field of Classification Search
CPC .... H01R 13/53; H01R 13/6616; H01R 39/46; H01R 39/54
(Continued)

(56) References Cited

U.S. PATENT DOCUMENTS 4,681,549 A 7/1987 Peterson
5,414,587 A * 5/1995 Kiser ..... B23Q 1/0063 361/118
(Continued)

FOREIGN PATENT DOCUMENTS

EP 1283565 A2 2/2003
WO 2011124563 A1 10/2011
WO 2013092174 A1 6/2013

OTHER PUBLICATIONS

International Search Report, International Application No. PCT/IB2017/054709, International Filing Date Aug. 1, 2017.

*Primary Examiner* — Edwin A. Leon
*Assistant Examiner* — Oscar Jimenez

(57) ABSTRACT

A power terminal includes a terminal beam having a mating surface. A protective thermal coupler bridge is positioned adjacent the terminal beam having a bridge conductor, an insulating substrate and a bridge pad. The bridge pad has a mating surface. A variable resistive member is electrically coupled between the terminal beam and the bridge conductor to provide a shunt so that arcing does not occur when the power terminal is disconnected from the mating power terminal. The mating surface of the terminal beam is separable before the mating surface of the bridge pad is disconnected so that the resistance in the variable resistive member increases after disconnection of the main power terminal from the mating power terminal and prior to disconnection of the bridge pad from the mating power terminal to shunt the current through the bridge conductor and the variable resistive member during unmating.

20 Claims, 8 Drawing Sheets

(51) Int. Cl.
*H01R 39/46* (2006.01)
*H01R 39/54* (2006.01)

(58) Field of Classification Search
USPC ..... 439/181
See application file for complete search history.

(56) References Cited

U.S. PATENT DOCUMENTS

| | | | | |
|---|---|---|---|---|
| 5,428,195 | A | 6/1995 | Arnold | |
| 6,659,783 | B2 | 12/2003 | Copper et al. | |
| 6,857,887 | B1 * | 2/2005 | Belson | H01R 13/6616 439/181 |
| 8,398,442 | B2 * | 3/2013 | Yagi | H01R 13/04 439/181 |
| 8,613,626 | B1 * | 12/2013 | Phan | H01R 13/11 439/181 |
| 9,277,649 | B2 * | 3/2016 | Ellison | H01R 12/523 |
| 9,548,553 | B2 * | 1/2017 | Glick | H01R 13/113 |
| 2008/0142344 | A1 | 6/2008 | Hickam | |
| 2013/0330940 | A1 | 12/2013 | Hasse et al. | |

* cited by examiner

POWER TERMINAL FOR ARCLESS POWER CONNECTOR

CROSS-REFERENCE TO RELATED APPLICATIONS

This application claims the benefit of U.S. Provisional Application No. 62/369,433, filed Aug. 1, 2016, titled "POWER TERMINAL FOR ARCLESS POWER CONNECTOR", the subject matter of which is herein incorporated by reference in its entirety.

BACKGROUND OF THE INVENTION

The subject matter herein relates generally to arcless power connectors.

Contacts carrying significant amounts of power will arc when disconnected. The amount of arc damage experienced by the contacts depends on their physical structure, the load current, the supply voltage, the speed of separation, the characteristics of the load (resistive, capacitive, inductive) as well as other factors.

Future automotive systems are expected to utilize high voltage, such as 48-volt operation or higher, to handle the increasing amount of electrical loads in vehicles. This increased voltage could cause significant arc damage to occur to the present connectors designed for 12-volt operation. Electrical connectors under load could become disengaged, such as during operation of the vehicle, leading to arcing. Conventional electrical connectors used in automotive applications require either that the current be shut off before the contacts are separated or unmated or employ a sacrificial contact portion. Components that ensure shut off of the current may include circuits that shut off the current prior to separation, which may include FET components or may have complex locking features that provide staged unlocking and separation. The cost, space, reliability, safety, performance and complexity of these conventional solutions make them unsuitable for many applications, including automotive electrical systems.

A need remains for electrical connectors for high voltage applications that allow disconnection of a live connection without arcing.

BRIEF DESCRIPTION OF THE INVENTION

In one embodiment, a power terminal is provided for an electrical connector configured to be mated with a mating power terminal of a mating electrical connector. The power terminal includes a terminal beam configured to be electrically coupled to a power wire. The terminal beam has a mating surface configured to be mated with the mating power terminal. A protective thermal coupler bridge is positioned adjacent the terminal beam. The protective thermal coupler bridge has a bridge conductor, an insulating substrate and a bridge pad. The bridge conductor is provided on the insulating substrate. The bridge pad is provided on the insulating substrate and is electrically coupled to the bridge conductor. The bridge pad has a mating surface configured to be mated with the mating power terminal. A variable resistive member is electrically coupled between the terminal beam and the bridge conductor. The variable resistive member provides a shunt so that arcing does not occur when the power terminal is disconnected from the mating power terminal of the mating electrical connector. The mating surface of the terminal beam is separable from the mating power terminal of the mating electrical connector before the mating surface of the bridge pad is disconnected from the mating power terminal of the mating electrical connector so that the resistance in the variable resistive member increases after disconnection of the main power terminal from the mating power terminal and prior to disconnection of the bridge pad from the mating power terminal to shunt the current through the bridge conductor and the variable resistive member during unmating.

In a further embodiment, an electrical connector is provided that is matable to and unmatable from a separable mating electrical connector. The electrical connector includes a housing having a mating end and a wire end. A power terminal is received in and held by the housing. The power terminal is matable with and unmatable from a mating power terminal of the mating electrical connector. The power terminal includes a terminal beam configured to be electrically coupled to a power wire. The terminal beam has a mating surface configured to be mated with the mating power terminal. A protective thermal coupler bridge is positioned adjacent the terminal beam. The protective thermal coupler bridge has a bridge conductor, an insulating substrate and a bridge pad. The bridge conductor is provided on the insulating substrate. The bridge pad is provided on the insulating substrate and is electrically coupled to the bridge conductor. The bridge pad has a mating surface configured to be mated with the mating power terminal. A variable resistive member is electrically coupled between the terminal beam and the bridge conductor. The variable resistive member provides a shunt so that arcing does not occur when the power terminal is disconnected from the mating power terminal of the mating electrical connector. The mating surface of the terminal beam is separable from the mating power terminal of the mating electrical connector before the mating surface of the bridge pad is disconnected from the mating power terminal of the mating electrical connector so that the resistance in the variable resistive member increases after disconnection of the main power terminal from the mating power terminal and prior to disconnection of the bridge pad from the mating power terminal to shunt the current through the bridge conductor and the variable resistive member during unmating.

DETAILED DESCRIPTION OF THE INVENTION

Figure 1:
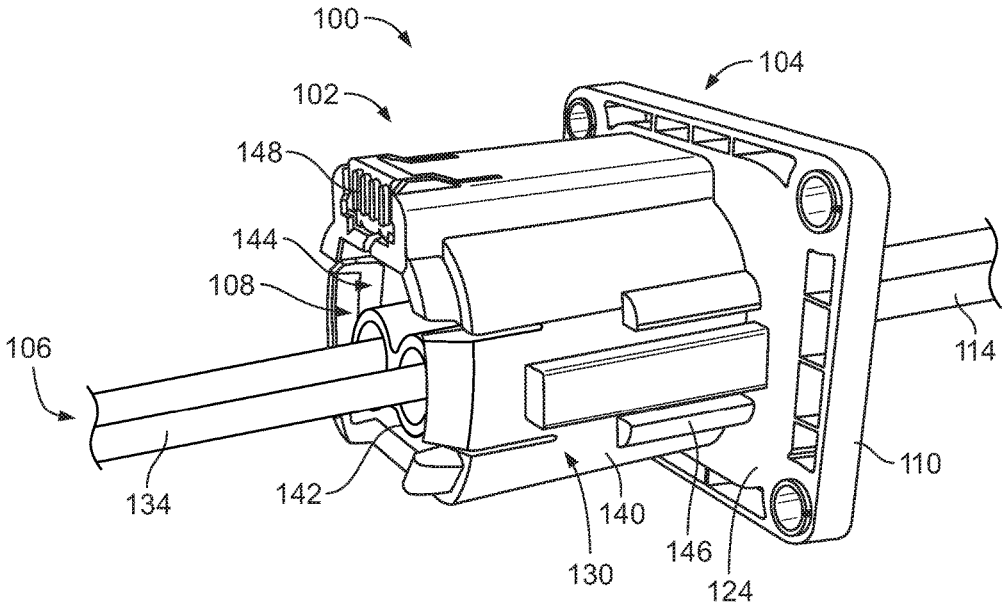
FIG. 1 is a front perspective view of a power connector system formed in accordance with an exemplary embodiment including first and second electrical connectors matable to and unmatable from each other.
Figure 2:
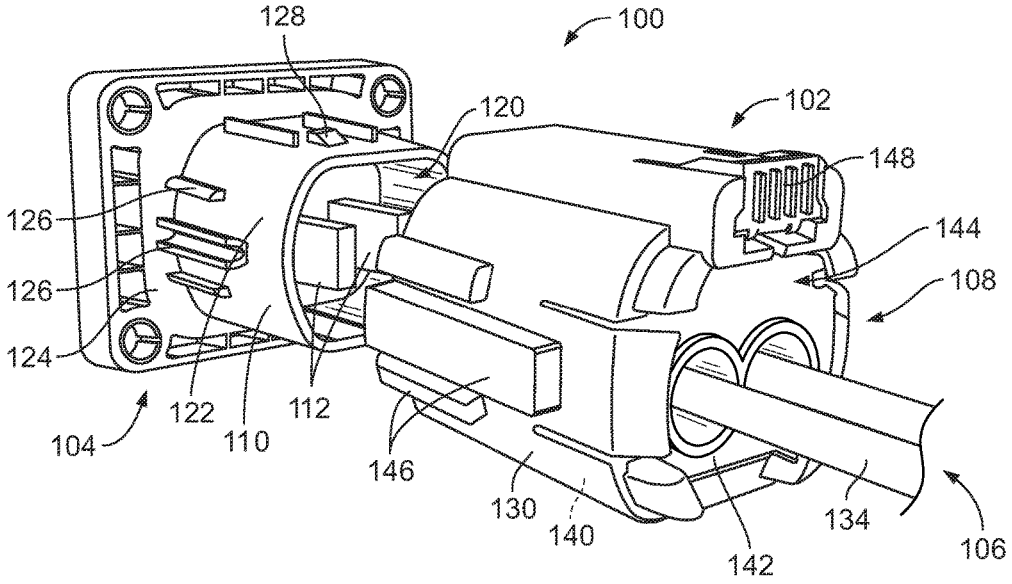
FIG. 2 is a front perspective view of the power connector system showing the electrical connectors unmated.

FIG. 1 is a front perspective view of a power connector system 100 formed in accordance with an exemplary embodiment including first and second electrical connectors 102, 104 matable to and unmatable from each other. Either of the electrical connectors 102, 104 may be referred to hereinafter as a mating electrical connector. FIG. 2 is a front perspective view of the power connector system 100 showing the electrical connector 102 unmated from the electrical connector 104.

The power connector system 100 includes a main power circuit 106 electrically connected by the electrical connectors 102, 104. In an exemplary embodiment, the main power circuit 106 is a high voltage power circuit, such as a 48 volt DC power circuit; however the main power circuit 106 may be used with any voltage in the system, including a higher voltage. The main power circuit 106 may be used in an automotive application, such as in a vehicle. The power connector system 100 may have application other than automotive applications in alternative embodiments.

The power connector system 100 includes an arc suppression circuit 108 electrically connected between the electrical connectors 102, 104. The arc suppression circuit 108 protects the components of the power connector system 100 from damage due to arcing when the electrical connectors 102, 104 are intentionally or unintentionally disconnected. The arc suppression circuit 108 allows the disconnection of the electrical connectors 102, 104 when the main power circuit 106 has a live connection making the electrical connectors 102, 104 hot swappable. Various embodiments of the arc suppression circuit 108 include a protective thermal coupler. The protective thermal coupler may incorporate a variable resistive member, such as a positive temperature coefficient resistor that varies resistance to current based on temperature.

In the illustrated embodiment, the electrical connector 104 is a header connector configured to be mounted to another device, such as a battery or a power distribution unit within a vehicle. The electrical connector 104 may be referred to hereinafter as a header connector 104. The electrical connector 102 is configured to be plugged into the header connector 104. The electrical connector 102 thus defines a plug connector and may be referred to hereinafter as plug connector 102.

The header connector 104 includes a housing 110, also referred to hereinafter as a header housing, holding a plurality of header power terminals 112 (FIG. 2), or simply power terminals 112. The power terminals 112 are electrically connected to corresponding power wires 114. The power terminals 112 and the power wires 114 define portions of the main power circuit 106. In an exemplary embodiment, some or all of the power terminals 112 define portions of the arc suppression circuit 108. In the illustrated embodiment, the power terminals 112 are blade terminals; however, other types of terminals may be used in alternative embodiments, such as a pin terminal, a receptacle terminal, or another type of terminal.

The header housing 110 includes a cavity 120 surrounded by a shroud wall 122. The header housing 110 includes a mounting flange 124 extending outward from the shroud wall 122. The mounting flange 124 may be used to mount the header housing 110 to another component, such as the battery or power distribution unit of the vehicle. In an exemplary embodiment, the header housing 110 includes one or more guide features 126 to guide mating with the electrical connector 102. In the illustrated embodiment, the guide features 126 are ribs extending from the shroud wall 122. Other types of guide features may be used in alternative embodiments, such as slots, keys, or other types of guide features. In an exemplary embodiment, the header housing 110 includes a securing feature 128 to secure the electrical connector 102 to the mating electrical connector 104. In the illustrated embodiment, the securing feature 128 is a catch extending from the shroud wall 122; however, other types of securing features may be used in alternative embodiments, such as a latch.

Figure 3:
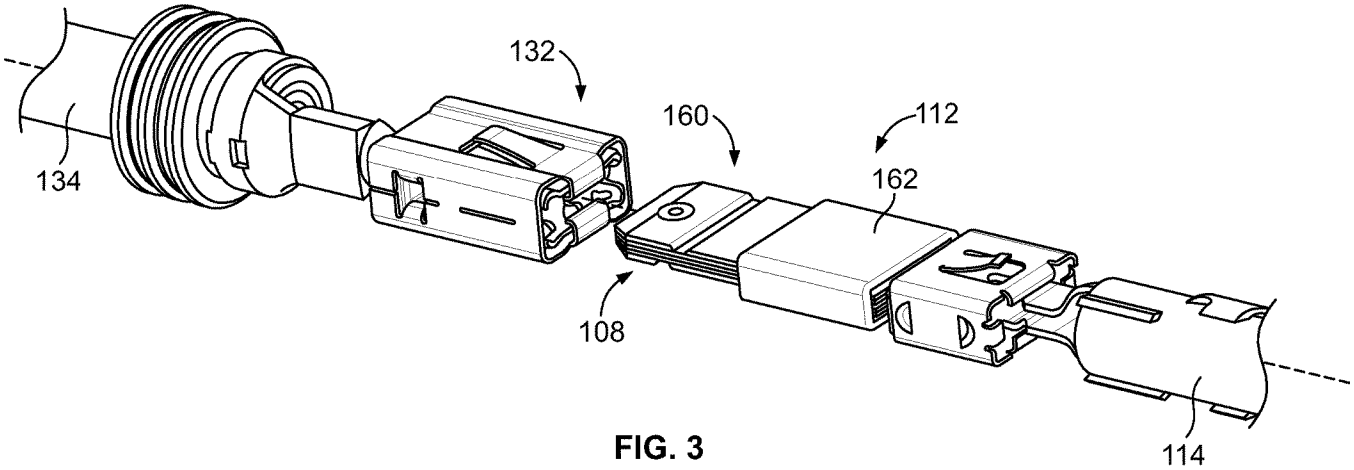
FIG. 3 is a perspective view of a portion of the power connector system illustrating power terminals of the electrical connectors in an unmated state.

The electrical connector 102 includes a plug housing 130 holding a plurality of power terminals 132 (shown in FIG. 3). The power terminals 132 are electrically connected to corresponding power wires 134. The power terminals 132 and the power wires 134 define portions of the main power circuit 106. Optionally, the power terminals 132 may define portions of the arc suppression circuit 108.

The housing 130 may be a multi-piece plug housing. For example, in the illustrated embodiment, the electrical connector 102 includes an outer housing 140 and an inner housing 142. The inner housing 142 defines part of a terminal assembly 144 of the electrical connector 102. The terminal assembly 144 is received in the outer housing 140. The terminal assembly 144 includes the power terminals 132. The terminal assembly 144 is configured to be received in the cavity 120 of the header housing 110. In an exemplary embodiment, the outer housing 140 of the electrical connector 102 surrounds the shroud wall 122 such that a portion of the header connector 104 is received in the electrical connector 102.

In an exemplary embodiment, the electrical connector 102 includes guide features 146 that interact with the guide features 126 of the electrical connector 104 to guide mating of the electrical connector 102 with the electrical connector 104. For example, the guide features 146 may be slots that receive the ribs of the electrical connector 104. Other types of guide features 146 may be provided in alternative embodiments. In an exemplary embodiment, the electrical connector 102 includes a securing feature 148 for securing the electrical connector 102 to the mating electrical connector 104. In the illustrated embodiment, the securing feature 148 is a latch; however, other types of securing features may be used in alternative embodiments.

Figure 4:
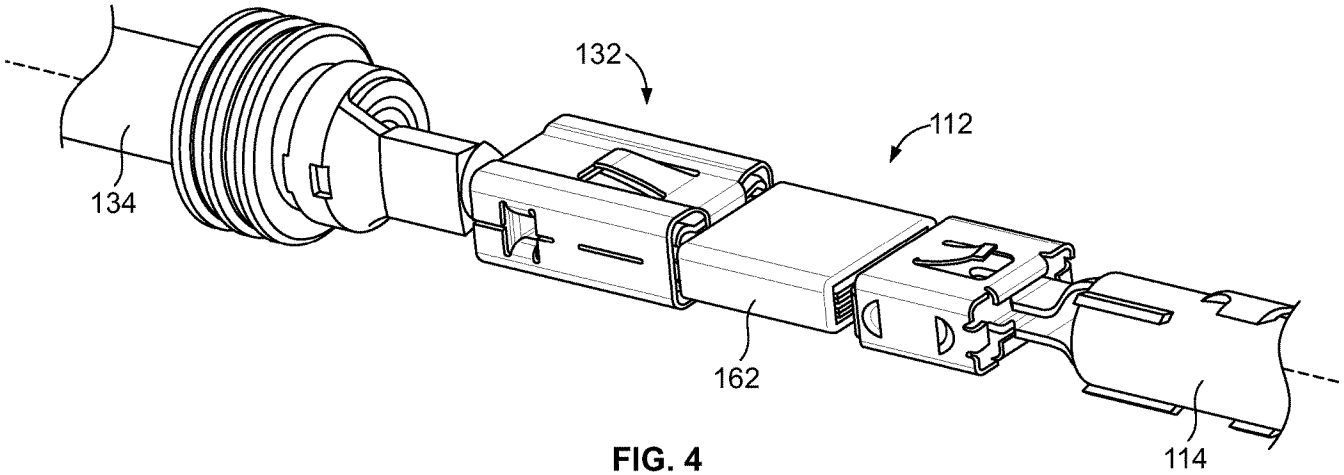
FIG. 4 is a perspective view of a portion of the power connector system illustrating the power terminals in a mated state.

FIG. 3 is a perspective view of a portion of the power connector system 100 with the housings 110, 130 removed to illustrate the power terminals 112, 132 in an unmated state. FIG. 4 is a perspective view of a portion of the power connector system 100 with the housings 110, 130 removed to illustrate the power terminals 112, 132 in a mated state. The power terminals 112, 132 may be mated and unmated along a mating axis 150. The power terminal 112 includes the arc suppression circuit 108; however the power terminal 132 may additionally or alternatively include components of the arc suppression circuit 108.

The power terminals 112, 132 are connected to the power wires 114, 134, respectively. In the illustrated embodiment, the power terminal 112 is a male type of terminal, such as a blade type of terminal, while the power terminal 132 is a female type of terminal, such as a socket or receptacle. The power terminals 112, 132 may be crimped to the corresponding power wires 114, 134; however the power terminals may be terminated by other means in alternative embodiments, such as welding. The power wire 134 is configured to be connected to a load and the power wire 114 is configured to be connected to a power supply, such as a battery, or vice versa.

The arc suppression circuit 108 includes a protective thermal coupler (PTC) 160 electrically coupled to the power terminal 112. The PTC 160 is incorporated into the power terminal 112, and thus there is no need for additional components or additional circuits for arc suppression, which may increase the overall size and complexity of the electrical connector 104. For example, if additional terminals and wires were needed for the arc suppression circuit 108, the electrical connector 104 would be larger and more expensive to manufacture. At least a portion of the PTC 160 may be received in the mating power terminal 132. Optionally, the PTC 160 includes a dielectric cover 162 covering components of the PTC 160 and covering portions of the main contacts of the power terminal 112.

During unmating, the main contacts of the power terminal 112, which may be referred to hereinafter as terminal beams, are configured to disconnect first, leaving the PTC 160 (e.g., mating contacts of the PTC 160) electrically connected to the power terminal 132. The power terminal 112 provides a sequenced mating and unmating between the various components, such as the main contacts of the power terminal 112 and the PTC 160. The arrangement of components parts and incorporation of the PTC 160 prevent arcing when the power terminals 112, 132 are unmated while carrying current.

In an exemplary embodiment, the PTC 160 includes a variable resistive member. The variable resistive member may be a conductive polymer member in which conductive particles are contained within a polymer matrix. Normally, the conductive particles form a conductive path that have a resistance that is larger than the resistance of the power terminal 112 so that under normal mated operation, the power terminal 112 would carry substantially all of the current. However, as current increases in the PTC 160, the polymer expands and the resistance increases. When current through the PTC 160 increases rapidly due to disconnection of the main power terminal 112, the resistance will increase rapidly due to resistive ($I^2R$) heating of the polymer. To prevent arcing when the power terminal 112 is unmated, the disconnect time for the power terminal 112 must be less than the time for the resistance of the PTC 160 to increase too greatly. Most of the current through the power terminal 112 must be carried by the PTC 160 until the power terminal 112 has moved to a position in which arcing is no longer possible. Before the PTC 160 is disconnected, the resistance in the PTC 160 must increase so that the current flow through the PTC 160 will drop below the arcing threshold before unmating. This time is called the trip time of the variable resistive member. Since the trip time of the PTC 160 will depend on the initial current through the power terminal 112, which can vary over a wide range, the trip time for a given electrical connector will therefore not be constant.

When the power terminals 112, 132 are fully mated and during normal operation, the power terminal 112 is carrying a high current. The current is primarily flowing between the power terminal 132 and the power terminal 112. Only a relatively small shunt current flows through the auxiliary portion or arc suppression circuit 108. During unmating, the main contacts of the power terminal 112 begin to separate and disconnect from the power terminal 132. It is while the terminals 112, 132 are in this initial disconnect state that arcing between the two electrical connectors 102, 104 is most likely when the voltage and current are above an arcing threshold, since a relatively large existing current is being disconnected. However, the PTC 160 limits the voltage and current across the opening gap to prevent arcing. The two terminals 112, 132 may not be completely separated during the initial disconnect, but rather may be subject to separation from contact bounce as spring members flex and as irregular surfaces on the terminals result in momentary separation and engagement. The duration of unmating should be less than the trip time for the PTC 160 so that the PTC 160 does not switch to an OFF or open condition before completion of the separation between the terminals 112, 132.

When the main contacts of the terminals 112, 132 initially physically separate, the variable resistive member of the PTC 160 has a low resistance state since there was only a small amount of current flowing through the PTC 160 prior to separation, causing the resistive heating of the variable resistive member to remain low. Since the resistance is relatively low, current flows through the PTC 160. The PTC 160 acts like a switch by varying the resistance (e.g., based on temperature). In the low resistance state, the PTC 160 can be said to be ON. While the PTC 160 remains connected to the power terminal 132, the current through the PTC 160 will increase and therefore resistive heating of the variable resistive member will increase. The resistance of the variable resistive member increases with increasing temperature. As the resistance increases, the PTC 160 will effectually open or, in other words, its resistance will significantly increase to a point where the circuit is no longer effectively conducting power. In such state, the PTC switch is said to be in the OFF position.

Prior to the time that the PTC 160 separates from the power terminal 132, the current flowing through the PTC 160 will be below the arcing threshold. This is due to the increased resistance of the PTC 160 during the sequenced unmating. When the PTC 160 finally separates, there may only be a small amount of leakage current flowing through the power terminals 112, 132. At this point there will be insufficient electrical energy to support an arc between the contact portions. The amount of time that elapses while the power terminals 112, 132 are unmating allows the current to fall below the arcing threshold before the PTC 160 is physically disconnected from the power terminal 132. Since current is no longer flowing, the PTC 160 will return or reset to a state of lower temperature and resistance.

Figure 5:
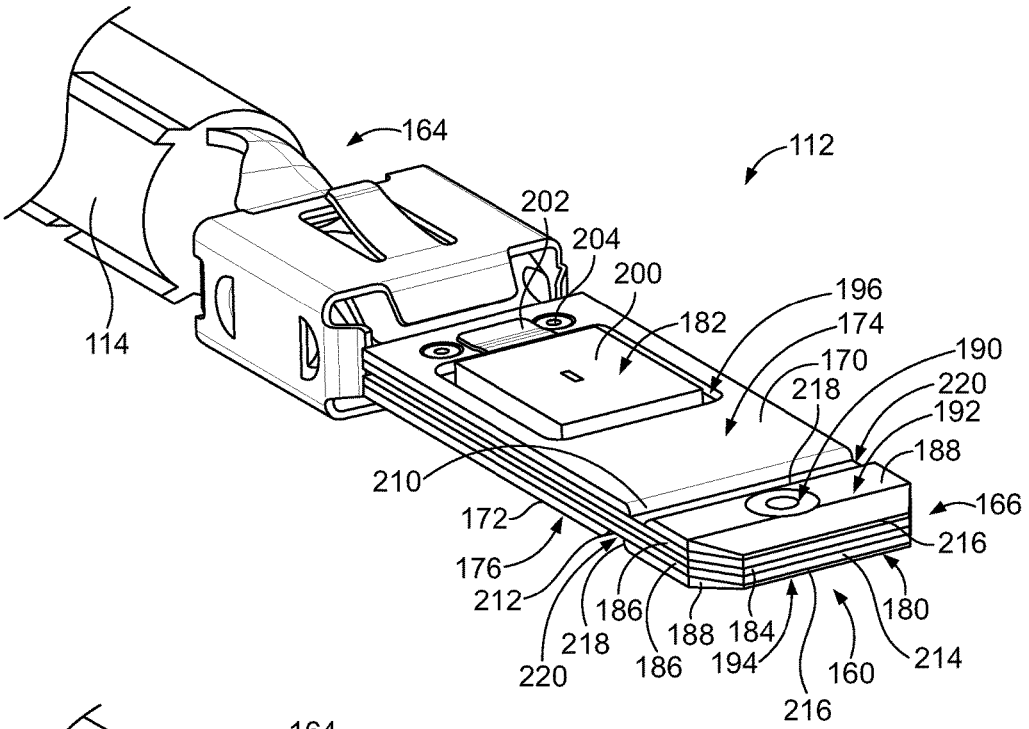
FIG. 5 is a front perspective view of a portion of one of the power terminal.
Figure 6:
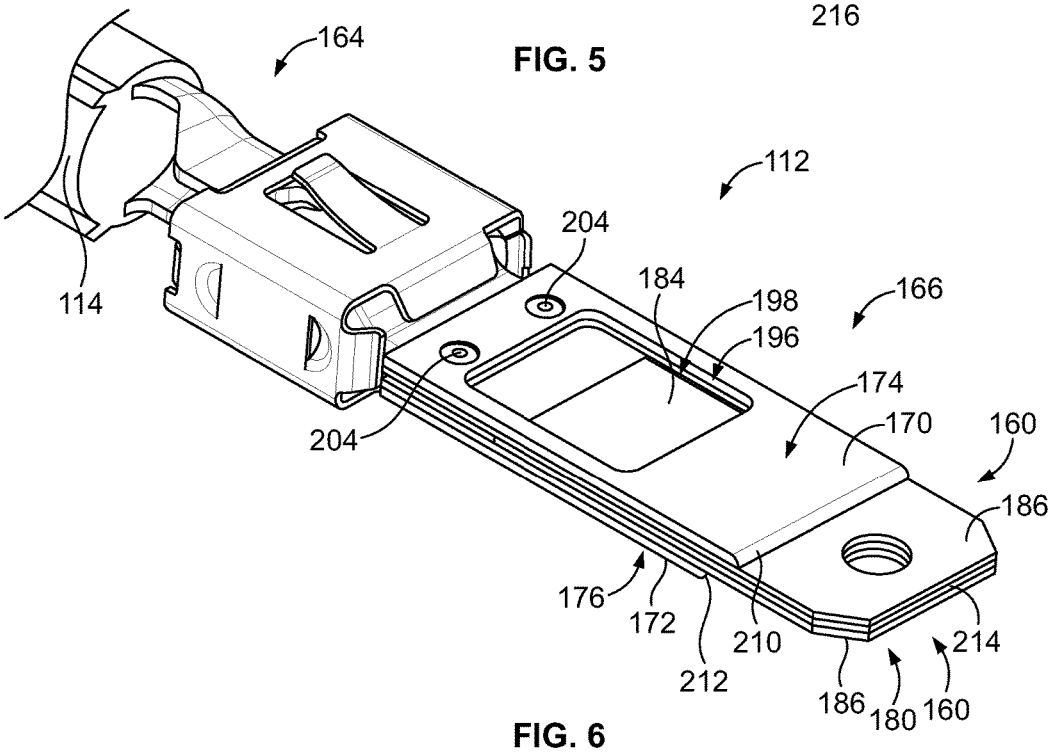
FIG. 6 is a front perspective view of a portion of one of the power terminal.

FIG. 5 is a front perspective view of a portion of the power terminal 112 with the cover 162 (shown in FIG. 3) removed to illustrate the various components of the PTC 160. FIG. 6 is a front perspective view of a portion of the power terminal 112 with a portion of the PTC 160 removed to illustrate various components thereof.

The power terminal 112 has a terminating end 164 and mating end 166 opposite the terminating end 164. The terminating end 164 is terminated to the power wire 114. In an exemplary embodiment, the power terminal 112 includes one or more terminal beams extending at least partially between the terminating end 164 and the mating end 166. In the illustrated embodiment, the power terminal 112 includes first and second terminal beams 170, 172; however the power terminal may include a single terminal beam or more than two terminal beams in alternative embodiments. The terminal beams 170, 172 define the main conductors of the main power circuit 106. The terminal beams 170, 172 may be stamped and formed. For example, the terminal beams 170, 172 may define a crimp barrel at the terminating end 164. The terminal beams 170, 172 may define contact pads at the mating end 166. The contact pads at the mating end include mating surfaces 174, 176 configured to be mated with the mating power terminal 132. Optionally, the terminal beams 170, 172 may be multiple-components. For example, the contact pads at the mating end 166 may be defined by conductive layers of a printed circuit component while the crimp barrel at the terminating end 164 may be defined by a stamped and formed, U-shaped barrel portion configured to be crimped to the power wire 114. Alternatively, the terminal beams 170, 172 may be defined as a single unitary structure, such as a stamped and formed structure that extends from the crimp barrel forward to the contact pads.

The PTC 160 includes a protective thermal coupler bridge 180 positioned adjacent the terminal beam 170 and/or 172 and a variable resistive member 182 electrically coupled between the terminal beam 170 and/or 172 and the protective thermal coupler bridge 180. In an exemplary embodiment, the protective thermal coupler bridge 180 is at least partially arranged between the terminal beams 170, 172, such as at the mating end 166. For example, the protective thermal coupler bridge 180 and the terminal beams 170, 172 may be arranged in a layered or stacked arrangement to define a single male type terminal, such as a blade type terminal, configured to be mated with the mating power terminal 132.

The protective thermal coupler bridge 180 and the variable resistive member 182 define the shunt path through the power terminal 112 for arc suppression. The protective thermal coupler bridge 180 and the variable resistive member 182 are configured to be disconnected from the mating power terminal 132 after the main terminal beams 170, 172 are disconnected. The variable resistive member 182 is configured to vary resistance from a low resistance state to a high resistance state to operate as a switch to reduce the flow of current through the PTC 160. Optionally, the variable resistive member 182 may vary resistance with temperature. In an exemplary embodiment, the variable resistive member 182 creates a variable resistance path between the mating power terminal 132 and the terminal beams 170, 172.

In an exemplary embodiment, the variable resistive member 182 includes a positive temperature coefficient resistive member that varies resistance based on temperature. For example, the resistance may increase as the temperature increases. The variable resistive member 182 includes a conductive polymer member with conductive particles immersed in a non-conductive polymer. Increased resistive heating caused by current flowing through the variable resistance path of the variable resistive member 182 causes the non-conductive polymer to expand to disrupt conductive paths formed by interconnected conductive particles.

The variable resistive member 182 is characterized in that an increase in electrical resistance of the variable resistive member 182 lags an inrush current through the variable resistive member 182 so that the variable resistive member carries a current approximately equal to the inrush current for a period of time referred to as a trip time. The trip time is the time it takes for the non-conductive polymer to expand to a point that the conductive paths formed by the interconnected conductive particles to no longer carry enough current to sustain arcing, thus having a current that is below an arcing threshold so that arcing does not occur upon disconnection of the power terminals 112, 132. The trip time is long enough for resistance in the variable resistive member 182 to increase sufficiently to reduce the current through the variable resistive path through the variable resistive member 182 below the arcing threshold so that arcing does not occur. The trip time is long enough to allow the variable resistive member 182 to switch from a first relatively low resistance state to a second relatively higher resistance state. In an exemplary embodiment, the resistance of the positive temperature coefficient resistor increases sufficiently rapidly between separation of the terminal beams 170, 172 and disconnection of the PTC 160 from the mating power terminal 132 so that the electrical energy flowing through the PTC 160 is reduced below an arcing threshold after separation of the terminal beams 170, 172 and before disconnection of the PTC 160.

The protective thermal coupler bridge 180 has at least one bridge conductor 184, at least one insulating substrate 186 and at least one bridge pad 188. The protective thermal coupler bridge 180 may be a layered structure. For example, the protective thermal coupler bridge 180 may be a printed circuit structure with the insulating substrate(s) 186 being internal insulating layers of the printed circuit (e.g., manufactured from FR4 material or similar circuit board material) and with the bridge conductor(s) 184 and the bridge pad(s) 188 being printed, conductive layers of the printed circuit. In the illustrated embodiment, the protective thermal coupler bridge 180 includes a central or internal conductive layer defining the bridge conductor 184, an upper insulating layer defining an upper insulating substrate 186, a lower insulating layer defining a lower insulating substrate 186, an external or upper conductive layer defining an upper bridge pad 188 and an external or lower conductive layer defining a lower bridge pad 188. The bridge conductor 184 is provided on at least one of the insulating substrates 186, such as the lower insulating substrate.

The upper bridge pad 188 is provided on the upper insulating substrate 186 and is electrically coupled to the bridge conductor 184 through the insulating substrate 186, such as using conductive vias 190. The upper bridge pad 188 has a mating surface 192 configured to be mated with the mating power terminal 132. For example, the upper bridge pad 188 may be exposed at the mating end 166. In an exemplary embodiment, the upper bridge pad 188 is exposed forward of the upper terminal beam 170. The lower bridge pad 188 is provided on the lower insulating substrate 186 and is electrically coupled to the bridge conductor 184 through the insulating substrate 186, such as using the conductive vias 190. The lower bridge pad 188 has a mating surface 194 configured to be mated with the mating power terminal 132. For example, the lower bridge pad 188 may be exposed at the mating end 166. In an exemplary embodiment, the lower bridge pad 188 is exposed forward of the lower terminal beam 172.

The variable resistive member 182 is electrically coupled between the terminal beam(s) 170 and/or 172 and the bridge conductor 184. The variable resistive member 182 provides a shunt so that arcing does not occur when the power terminal 112 is disconnected from the mating power terminal 132. In an exemplary embodiment, the variable resistive member 182 is integrated into the power terminal 112. For example, the variable resistive member 182 may be at least partially recessed into the power terminal 112, such as into the upper terminal beam 170 and/or into the protective thermal coupler bridge 180. In the illustrated embodiment, the upper terminal beam 170 includes a pocket 196 that receives the variable resistive member 182. The variable resistive member 182 is provided at the bottom of the pocket 196. Optionally, the top of the variable resistive member 182 may be approximately flush or coplanar with the outer surface of the upper terminal beam 170 to maintain a low profile for the power terminal 112. Optionally, the protective thermal coupler bridge 180 may include a pocket 198 that receives the variable resistive member 182. For example, the upper insulating substrate 186 may include the pocket 198, which exposes a portion of the bridge conductor 184 such that the variable resistive member 182 may be terminated directly to the bridge conductor 184. The pockets 196, 198 may be sized to allow the variable resistive member 182 to expand, such as when heated. In other various embodiments, the variable resistive member 182 may be electrically coupled to the bridge conductor 184 be conductive vias, by a spring beam, or by another conductive path. In alternative embodiments, the variable resistive member 182 may additionally or alternatively be provided at the bottom of the power terminal 112, such as in the lower terminal beam 172 and/or in the lower insulating substrate 186.

In an exemplary embodiment, the variable resistive member 182 includes a variable resistive member contact 200, such as on the outer surface thereof. The variable resistive member contact 200 is configured to be electrically coupled to the terminal beam 170. For example, the variable resistive member contact 200 includes a spring beam 202 extending therefrom. The spring beam 202 may be spring biased against the terminal beam 170 to electrically connect the variable resistive member 182 to the terminal beam 170. The spring beam 202 may accommodate expansion and contraction of the variable resistive member 182, such as from heating when current flows through the variable resistive member 182, while maintaining the electrical connection with the terminal beam 170.

In an exemplary embodiment, the contact pads of the terminal beams 170, 172 are conductive layers of the printed circuit structure forming the protective thermal coupler bridge 180. The upper and lower insulating substrates 186 are positioned between the bridge conductor 184 and the upper and lower terminal beams 170, 172 to provide electrical isolation between the bridge conductor 184 and the terminal beams 170, 172. As such, the bridge conductor 184 is only electrically connected to the terminal beams 170, 172 through the variable resistive member 182. The terminal beams 170, 172 are electrically connected to each other through conductive vias 204, such as plated vias, through the insulating substrates 186. The conductive vias 204 are electrically isolated from the bridge conductor 186 by the insulating substrates 186. The contact pads of the terminal beams 170, 172 may be electrically connected to the crimp barrel portions of the terminal beams 170, 172 through the conductive vias 204.

The contact pads of the terminal beams 170, 172 extend to corresponding front edges 210, 212. The front edges 210, 212 may be recessed rearward of a front 214 of the power terminal 112. In an exemplary embodiment, the front edges 210, 212 are staggered or offset with respect to each other along the mating axis 150 such that the second terminal beam 172 is separable from the mating power terminal 132 before the first terminal beam 170 separates from the mating power terminal 132. For example, the upper front edge 210 may be positioned forward of the lower front edge 212, or vice versa.

In an exemplary embodiment, the upper and lower bridge pads 188 are positioned forward of the contact pads of the terminal beams 170, 172. For example, the first and second bridge pads 188 both include front edges 216 and rear edges 218. The front edges 216 may be provided at or near the front 214. The rear edges 218 face the front edges 210, 212 across corresponding first and second gaps 220. The gaps 220 electrically isolate the bridge pads 188 from the terminal beams 170, 172. As such, the bridge pads 188 are only electrically connected to the terminal beams 170, 172 through the bridge conductor 184 and the variable resistive member 182. The mating surfaces 174, 176 of the terminal beams 170, 172 are aligned with the mating surfaces 192, 194, respectively, of the upper and lower bridge pads 188 along the mating axis 150 but are staggered front-to-back. In an exemplary embodiment, the second or lower gap 220 between the lower bridge pad 188 and the lower terminal beam 172 is offset with respect to the first or upper gap 220 between the upper bridge pad 188 and the upper terminal beam 170 along the mating axis 150 such that the second terminal beam 172 is separable from the mating power terminal 132 at the second gap 220 while the first terminal beam 170 remains connected to the mating power terminal 132. The second or lower bridge pad 188 is configured to be connected to the mating power terminal 132 while the first terminal beam 170 is separated from the mating power terminal 132 at the first gap 220.

During unmating, the mating surface 174 of the terminal beam 170 is separable from the mating power terminal 132 before the mating surface 192 of the upper bridge pad 188 is disconnected from the mating power terminal 132 and the mating surface 176 of the terminal beam 172 is separable from the mating power terminal 132 before the mating surface 194 of the lower bridge pad 188 is disconnected from the mating power terminal 132. When the terminal beams 170, 172 are disconnected, the current flows through the PTC 160. The resistance in the variable resistive member 182 increases after disconnection of the main terminal beams 170, 172 from the mating power terminal 132 and prior to disconnection of the bridge pads 188 from the mating power terminal 132 to shunt the current through the bridge conductor 184 and the variable resistive member 182 during unmating.

Figure 7:
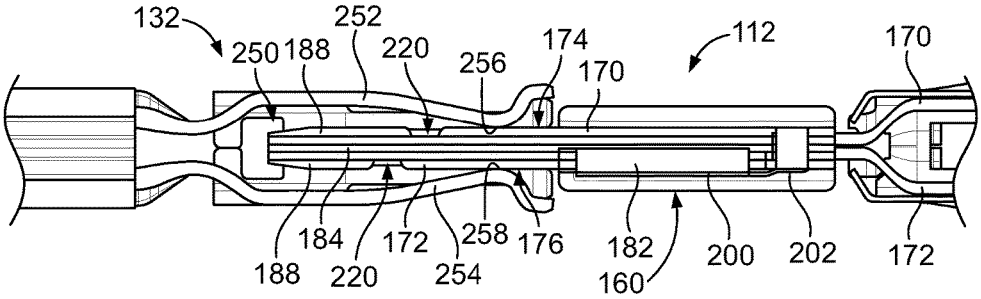
FIG. 7 is a cross sectional view of the power terminals in a fully mated state.
Figure 8:
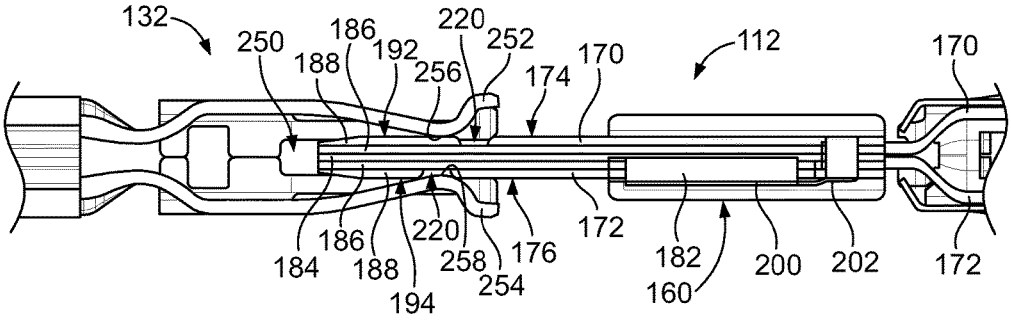
FIG. 8 is a cross sectional view of the power terminals in a partially unmated state.
Figure 9:
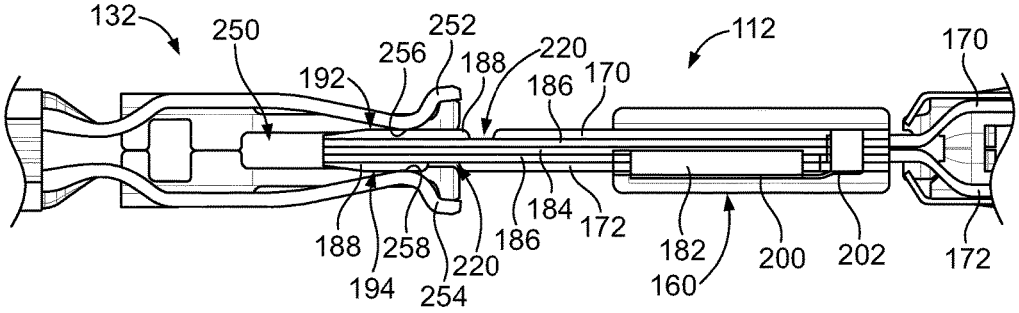
FIG. 9 is a cross sectional view of the power terminals in a bypassing or arc suppression state.
Figure 10:
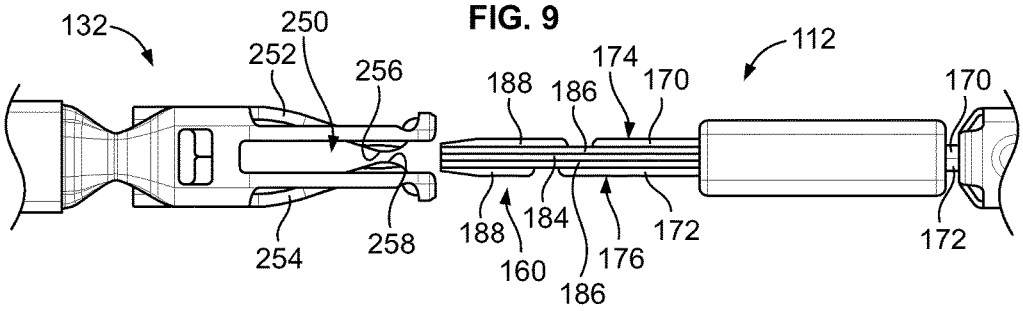
FIG. 10 is side view of the power terminals in a fully unmated state.

FIG. 7 is a cross sectional view of the power terminal 112 and the mating power terminal 132 in a fully mated state. FIG. 8 is a cross sectional view of the power terminal 112 and the mating power terminal 132 in a partially unmated state. FIG. 9 is a cross sectional view of the power terminal 112 and the mating power terminal 132 in a partially unmated, bypassing or arc suppression state. FIG. 10 is side view of the power terminal 112 and the mating power terminal 132 in a fully unmated state.

The mating power terminal 132 includes a socket 250 defined between first and second mating beams 252, 254. The mating beams 252, 254 having mating interfaces 256, 258, respectively, configured to slidably engage the various mating surfaces 174, 176 and 192, 194 of the terminal beams 170, 172 and the bridge pads 188 during mating and unmating. In the fully mated state (FIG. 7) the mating beams 252, 254 engage the terminal beams 170, 172, respectively. Current flows from the mating power terminal 132 to the power terminal 112 through the terminal beams 170, 172 without flowing through the PTC 160.

During unmating, the mating beams 252, 254 slide in an unmating direction to disconnect from the terminal beams 170, 172. In an exemplary embodiment, the power terminals 112, 132 have a sequenced mating and unmating arrangement. The first mating beam 252 is configured to disconnect from the first terminal beam 170 first during unmating. For example, during unmating, the first mating beam 252 initially reaches the first gap 220 and then the first bridge pad 188 while the second mating beam 254 remains coupled to the second terminal beam 172. For example, FIG. 8 illustrates the first mating beam 252 coupled to the first bridge pad 188 and the second mating beam 254 coupled to the second terminal beam 172. The current tends to flow through the second terminal beam 172 as opposed to the PTC 160 because the resistance in the PTC 160 is higher than the resistance in the second terminal beam 172.

As the power terminals 112, 132 are further unmated, the power terminals 112, 132 are eventually moved to the bypassing or arc suppressing state (FIG. 9). In the arc suppressing state, both mating beams 252, 254 have moved past the first and second gaps 220 to the first and second bridge pads 188. The mating beams 252, 254 are no longer directly connected to the terminal beams 170, 172. The current flows through the PTC 160 to the terminal beams 170, 172. The bridge pads 188 are electrically coupled to the bridge conductor 184. The current flows through the bridge conductor 184 to the variable resistive member 182. The current flows from the variable resistive member 182 to the terminal beams 170, 172 through the variable resistive member contact 200 and the spring beam 202. The PTC 160 shunts the current flow through the power terminal 112. The PTC 160 increases resistance over time to decrease the current flow to reduce the risk of arcing.

The power terminals 112, 132 are further unmated to the fully unmated state (FIG. 10). The mating beams 252, 254 are separated and disconnected from the bridge pads 188 in the fully unmated state.

Figure 11:
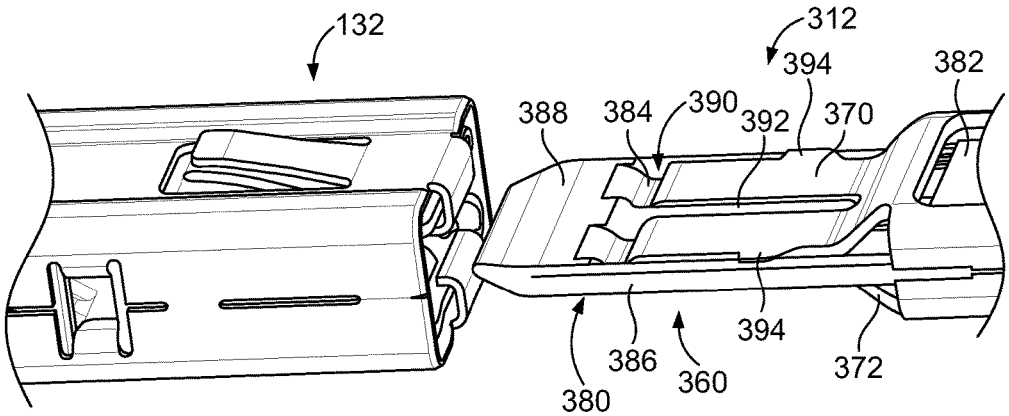
FIG. 11 is a front perspective view of a portion of a power terminal formed in accordance with an exemplary embodiment.

FIG. 11 is a front perspective view of a portion of a power terminal 312 formed in accordance with an exemplary embodiment. The power terminal 312 is similar to the power terminal 112 and may be used in the power connector system 100 in place of the power terminal 112 for mating with the mating power terminal 132. The power terminal 312 includes upper and lower or first and second terminal beams 370, 372, which may be similar to the terminal beams 170, 172. In the illustrated embodiment, the terminal beams 370, 372 are stamped and formed beams configured to extend from the terminating end to the mating end of the power terminal 312. The contact pad portions of the terminal beams 370, 372 are integral with the crimp barrel portions of the terminal beams 370, 372, as opposed to be separate components electrically coupled together as with the terminal beams 170, 172.

The power terminal 312 includes a protective thermal coupler (PTC) 360 for providing arc suppression. The PTC 360 includes a protective thermal coupler bridge 380 positioned adjacent the terminal beam 370 and/or 372 and a variable resistive member 382 electrically coupled between the terminal beam 370 and/or 372 and the protective thermal coupler bridge 380. In an exemplary embodiment, the protective thermal coupler bridge 380 is at least partially arranged between the terminal beams 370, 372. For example, the protective thermal coupler bridge 380 and the terminal beams 370, 372 may be arranged in a layered or stacked arrangement to define a single male type terminal, such as a blade type terminal, configured to be mated with the mating power terminal 132.

The protective thermal coupler bridge 380 and the variable resistive member 382 define the shunt path through the power terminal 312 for arc suppression. The protective thermal coupler bridge 380 and the variable resistive member 382 are configured to be disconnected from the mating power terminal 132 after the main terminal beams 370, 372 are disconnected. The variable resistive member 382 may be similar to the variable resistive member 182 (shown in FIG. 5). The variable resistive member 382 is configured to vary resistance from a low resistance state to a high resistance state to operate as a switch to reduce the flow of current through the PTC 360. Optionally, the variable resistive member 382 may vary resistance with temperature. In an exemplary embodiment, the variable resistive member 382 creates a variable resistance path between the mating power terminal 132 and the terminal beams 370, 372.

Figure 12:
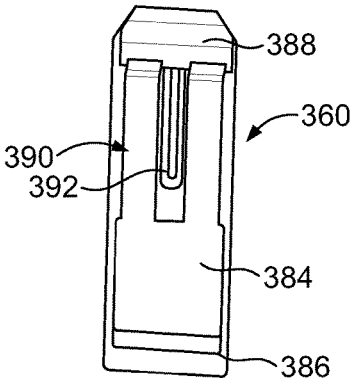
FIG. 12 is a top view of a protective thermal coupler of the power terminal shown in FIG. 11 in accordance with an exemplary embodiment.
Figure 13:
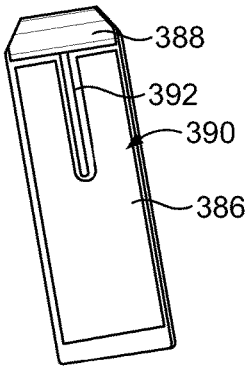
FIG. 13 is a bottom view of the protective thermal coupler.

FIG. 12 is a top view of the PTC 360 in accordance with an exemplary embodiment. FIG. 13 is a bottom view of the PTC 360. The protective thermal coupler bridge 380 has at least one bridge conductor 384, at least one insulating substrate 386 and at least one bridge pad 388. The protective thermal coupler bridge 380 may be a layered structure. For example, in the illustrated embodiment, the bridge conductor 384 and the bridge pads 388 are plated layers on the insulating substrate 386. The insulating substrate 386 is a molded tray configured to receive the plated circuits.

In the illustrated embodiment, the bridge conductor 384 is plated on the top of the insulating layer 386 and extends to a mounting area for the variable resistive member 382 (shown in FIG. 11). An upper conductive layer defines an upper bridge pad 388 on the top surface of the insulating substrate 386 and a lower conductive layer defines a lower bridge pad 388 on the bottom surface of the insulating substrate 386. Both the upper and lower bridge pads 388 are electrically connected to the bridge conductor 384. For example, the bridge pads 388 and the bridge conductor 384 are formed by a common plating process on the insulating substrate 386. The lower bridge pad 388 may wrap around the front to the top surface to connect with the upper bridge pad 388. Alternatively, the lower bridge pad 388 may be connected to the upper bridge pad 388 through the insulating substrate 386, such as through a plated via.

With additional reference back to FIG. 11, the upper bridge pad 388 defines a mating surface configured to be mated with the mating power terminal 132. The upper bridge pad 388 is exposed forward of the upper terminal beam 370. The lower bridge pad 388 defines a mating surface configured to be mated with the mating power terminal 132. The lower bridge pad 388 is exposed forward of the lower terminal beam 372. The upper and lower bridge pads 388 may have different depths (e.g., from the front) to provide a staggered or offset, sequenced mating and unmating interface. The front ends of the terminal beams 370, 372 may be provided at different depths (e.g., from the front) to provide a staggered or offset, sequenced mating and unmating interface.

The insulating substrate 386 may include wells or pockets 390 on the top and bottom surfaces for receiving the terminal beams 370, 372. Separating walls 392 may be provided for separating the pockets 390 for receiving different portions of the terminal beams 370, 372 and/or for positioning the terminal beams 370, 372. Optionally, the terminal beams 370, 372 may include wings 394 extending therefrom that engage the insulating substrate 386 for locating the terminal beams 370, 372 on the insulating substrate 386. The wings 394 may hold the terminal beams 370, 372 in spaced apart relation to the bridge conductor 384 and/or the bridge pads 388 to ensure that the terminal beams 370, 372 do not short circuit to the bridge conductor 384 and/or the bridge pads 388. Air gaps may be provided as an insulating layer between the terminal beams 370, 372 and the bridge conductor 384 and/or the bridge pads 388.

Figure 14:
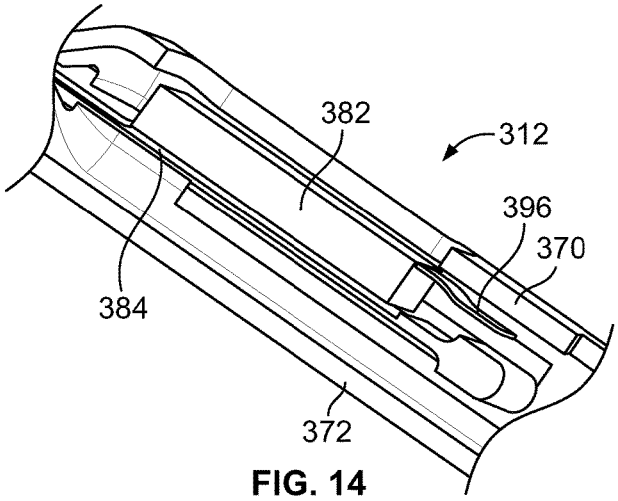
FIG. 14 illustrates a portion of the power terminal shown in FIG. 11 showing a variable resistive member.

FIG. 14 illustrates a portion of the power terminal 312 showing the variable resistive member 382. The variable resistive member 382 is coupled directly to the bridge conductor 384. The variable resistive member 382 is housed inside the power terminal 312 between the terminal beams 370, 372. A spring beam 396 of the variable resistive member 382 is configured to engage and electrically connect to the terminal beam 370 and/or 372.

The variable resistive member 382 is electrically coupled between the terminal beam(s) 370 and/or 372 and the bridge conductor 384. The variable resistive member 382 provides a shunt so that arcing does not occur when the power terminal 312 is disconnected from the mating power terminal 132. The pocket that receives the variable resistive member 382 may be sized to allow the variable resistive member 382 to expand, such as when heated.

Figure 15:
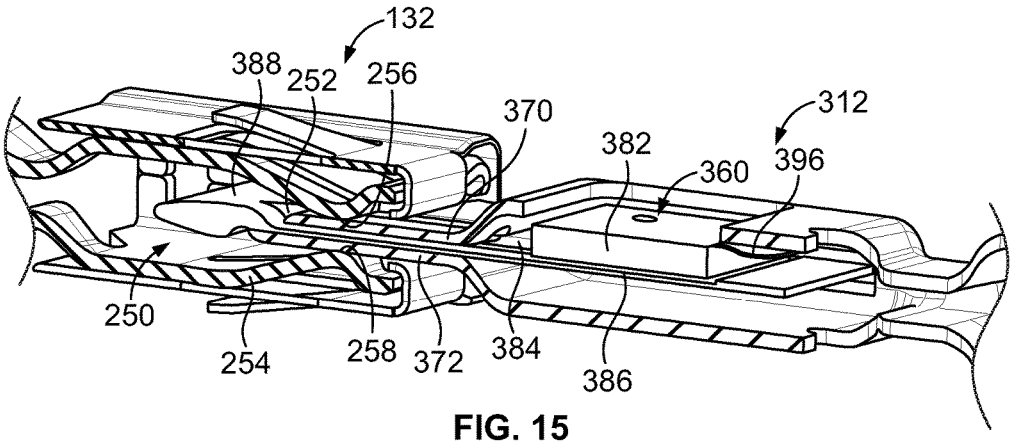
FIG. 15 is a sectional view of the power terminals in a fully mated state.
Figure 16:
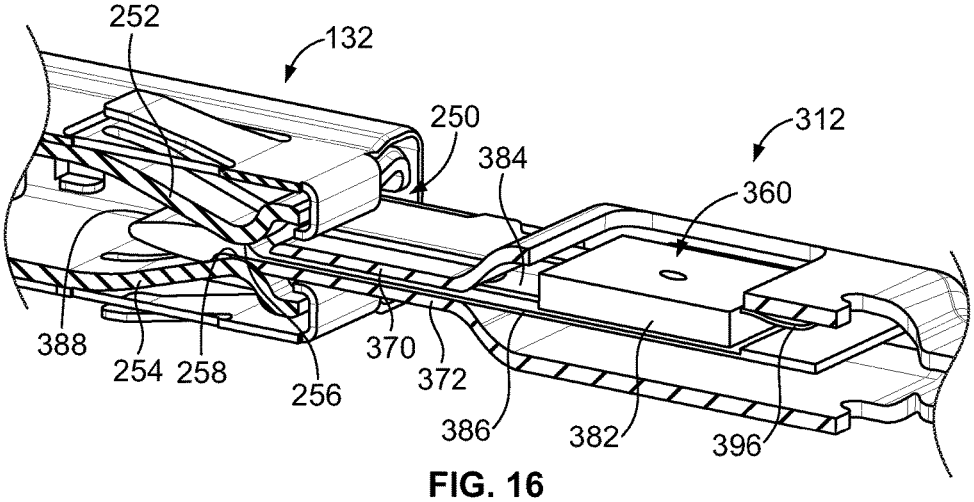
FIG. 16 is a sectional view of the power terminals in a partially unmated state.
Figure 17:
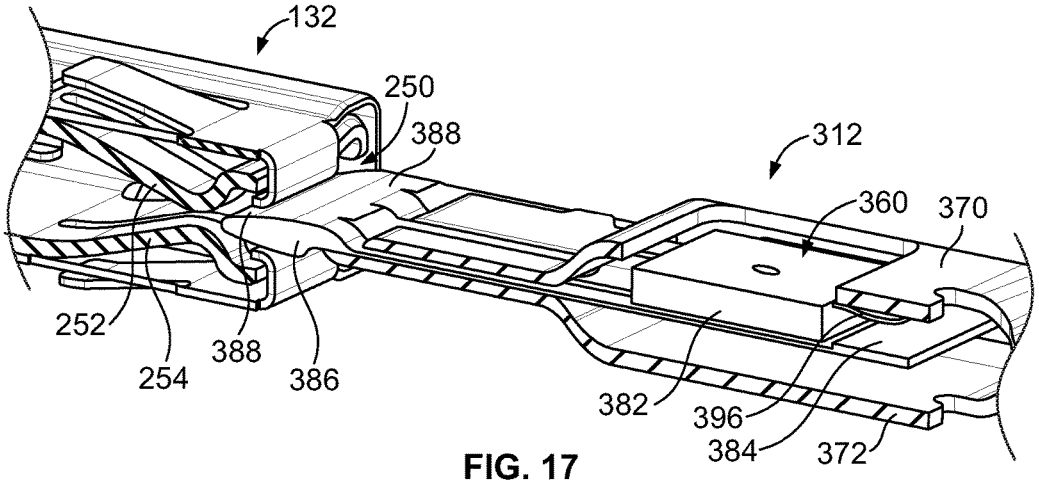
FIG. 17 is a cross sectional view of the power terminals in a fully unmated state.

FIG. 15 is a sectional view of the power terminal 312 and the mating power terminal 132 in a fully mated state. FIG. 16 is a sectional view of the power terminal 312 and the mating power terminal 132 in a partially unmated state. FIG. 17 is a cross sectional view of the power terminal 312 and the mating power terminal 132 in an unmated state, such as immediately after unmating. After unmating, the power terminal 312 may be further separated and removed from the power terminal 312.

The power terminal 112 is received in the socket 250 of the mating power terminal 132 between the upper and lower mating beams 252, 254. The mating interfaces 256, 258 of the mating beams 252, 254, respectively, are configured to slidably engage the various mating surfaces of the terminal beams 370, 372 and the bridge pads 388 during mating and unmating. In the fully mated state (FIG. 15) the mating beams 252, 254 engage the terminal beams 370, 372, respectively. Current flows from the mating power terminal 132 to the power terminal 312 through the terminal beams 370, 372 without flowing through the PTC 360.

During unmating, the mating beams 252, 254 slide in an unmating direction to disconnect from the terminal beams 370, 372. In an exemplary embodiment, the power terminals 312, 132 have a sequenced mating and unmating arrangement. The upper mating beam 252 is configured to disconnect from the upper terminal beam 370 first during unmating. For example, during unmating, the upper mating beam 252 initially reaches the upper gap between the upper bridge pad 388 and the upper terminal beam 370. FIG. 16 illustrates the upper mating beam 252 coupled to the upper bridge pad 388 and the lower mating beam 254 coupled to the lower terminal beam 372. The current tends to flow through the lower terminal beam 372 as opposed to the PTC 360 because the resistance in the PTC 360 is higher than the resistance in the lower terminal beam 372. After both mating beams 252, 254 are disconnected from the terminal beams 370, 372 and engaging the upper and lower bridge pads 388, the current bypasses the terminal beams 370, 372 and flows through the PTC 360 for arc suppression. The current flows through the PTC 360 to the terminal beams 370, 372. The current flows through the bridge conductor 384 to the variable resistive member 382. The current flows from the variable resistive member 382 to the terminal beams 370, 372 through the spring beam 396. The PTC 360 shunts the current flow through the power terminal 312. The PTC 360 increases resistance over time to decrease the current flow to reduce the risk of arcing.

The power terminals 312, 132 are further unmated to the fully unmated state (FIG. 17). FIG. 17 illustrates the power terminals 312, 132 immediately after unmating, after which, the power terminals 312, 132 may be further separated from each other. The mating beams 252, 254 are separated and disconnected from the bridge pads 388 in the fully unmated state. No portion of the power terminal 312 engages the power terminal 132 in the unmated state.

Figure 18:
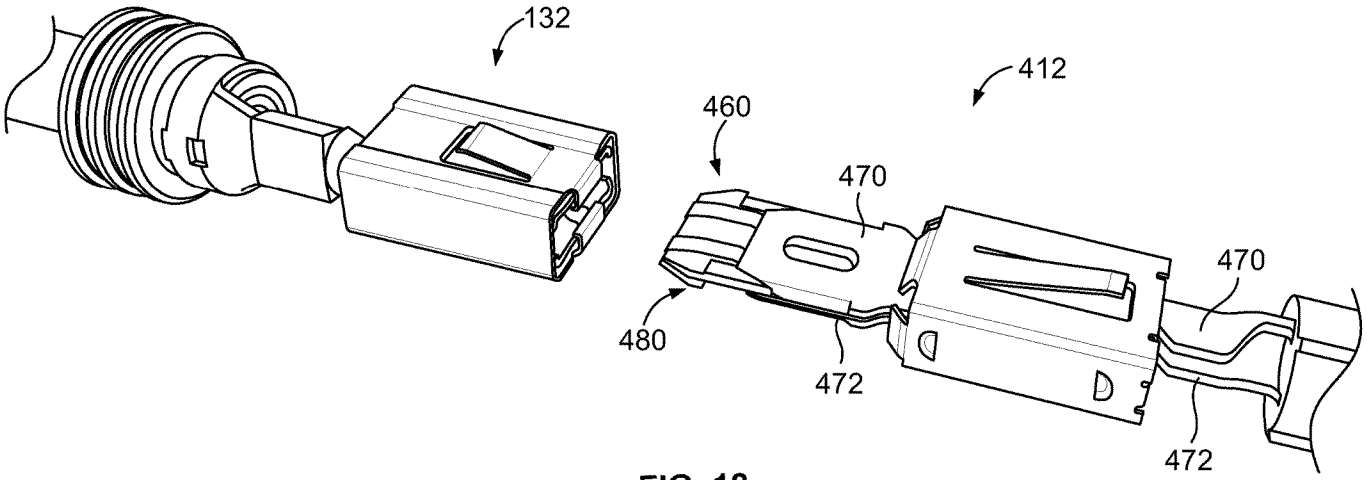
FIG. 18 is a front perspective view of a portion of a power terminal formed in accordance with an exemplary embodiment.
Figure 19:
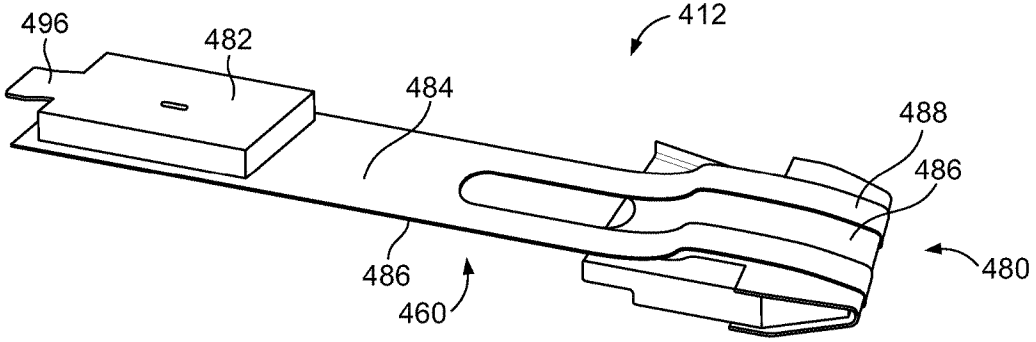
FIG. 19 is a perspective view of a portion of the power terminal shown in FIG. 18 in accordance with an exemplary embodiment.

FIG. 18 is a front perspective view of a portion of a power terminal 412 formed in accordance with an exemplary embodiment. FIG. 19 is a perspective view of a portion of the power terminal 412 in accordance with an exemplary embodiment. The power terminal 412 is similar to the power terminals 112, 312 and may be used in the power connector system 100 in place of the power terminals 112, 312 for mating with the mating power terminal 132. The power terminal 412 includes upper and lower or first and second terminal beams 470, 472, which may be similar to the terminal beams 170, 172. In the illustrated embodiment, the terminal beams 470, 472 are stamped and formed beams configured to extend from the terminating end to the mating end of the power terminal 412. The contact pad portions of the terminal beams 470, 472 are integral with the crimp barrel portions of the terminal beams 470, 472, as opposed to being separate components electrically coupled together as with the terminal beams 170, 172.

The power terminal 412 includes a protective thermal coupler (PTC) 460 for providing arc suppression. The PTC 460 includes a protective thermal coupler bridge 480 positioned adjacent the terminal beam 470 and/or 472 and a variable resistive member 482 (FIG. 19) configured to be electrically coupled between the terminal beam 470 and/or 472 and the protective thermal coupler bridge 480. The variable resistive member 482 may be electrically connected to the terminal beam 470 and/or 472, such as by a spring beam 496 or another type of electrical connection. The protective thermal coupler bridge 480 may be similar to the protective thermal coupler bridge 380; however, the protective thermal coupler bridge 480 includes a flexible polymeric film as opposed to a molded substrate. The variable resistive member 482 may be similar to the variable resistive member 182 and/or 382. In an exemplary embodiment, the protective thermal coupler bridge 480 is at least partially arranged between the terminal beams 470, 472. For example, the protective thermal coupler bridge 480 and the terminal beams 470, 472 may be arranged in a layered or stacked arrangement to define a single male type terminal, such as a blade type terminal, configured to be mated with the mating power terminal 132.

The protective thermal coupler bridge 480 and the variable resistive member 482 define the shunt path through the power terminal 412 for arc suppression. The protective thermal coupler bridge 480 and the variable resistive member 482 are configured to be disconnected from the mating power terminal 132 after the main terminal beams 470, 472 are disconnected. The variable resistive member 482 is configured to vary resistance from a low resistance state to a high resistance state to operate as a switch to reduce the flow of current through the PTC 460. Optionally, the variable resistive member 482 may vary resistance with temperature. In an exemplary embodiment, the variable resistive member 482 creates a variable resistance path between the mating power terminal 132 and the terminal beams 470, 472.

The protective thermal coupler bridge 480 has at least one bridge conductor 484, at least one insulating substrate 486 and at least one bridge pad 488. The protective thermal coupler bridge 480 may be a layered structure. For example, in the illustrated embodiment, the bridge conductor 484 and the bridge pads 488 are printed circuits on the insulating substrate 486. The insulating substrate 486 is a polymeric film. The insulating substrate 486 may be flexible. The bridge pads 488 may be formed on both the top and bottom surfaces of the insulating substrate 486. Alternatively, the insulating substrate may be wrapped around another structure to provide bridge pads 388 on both the top and the bottom of the protective thermal coupler bridge 480.

Figure 20:
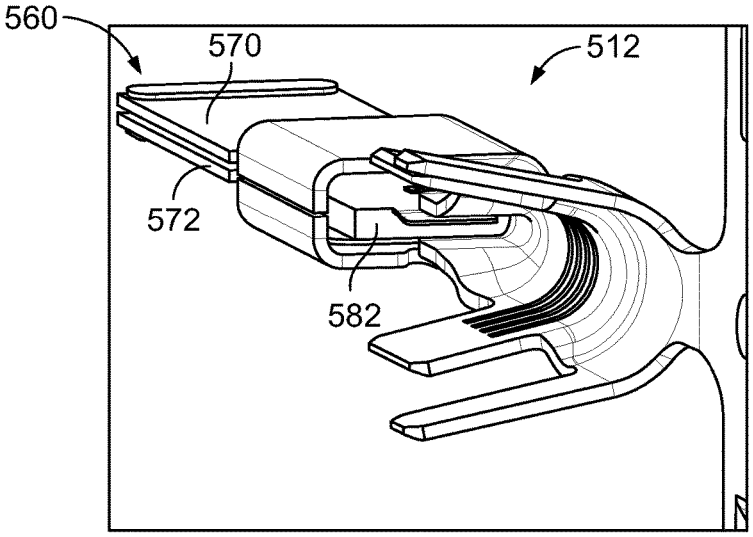
FIG. 20 is a front perspective view of a portion of a power terminal formed in accordance with an exemplary embodiment.
Figure 21:
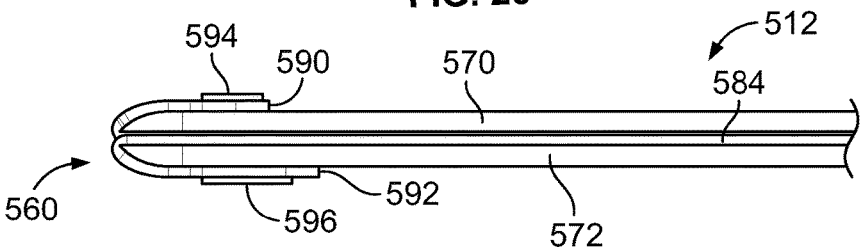
FIG. 21 is a side view of a portion of the power terminal shown in FIG. 20 in accordance with an exemplary embodiment.
Figure 22:
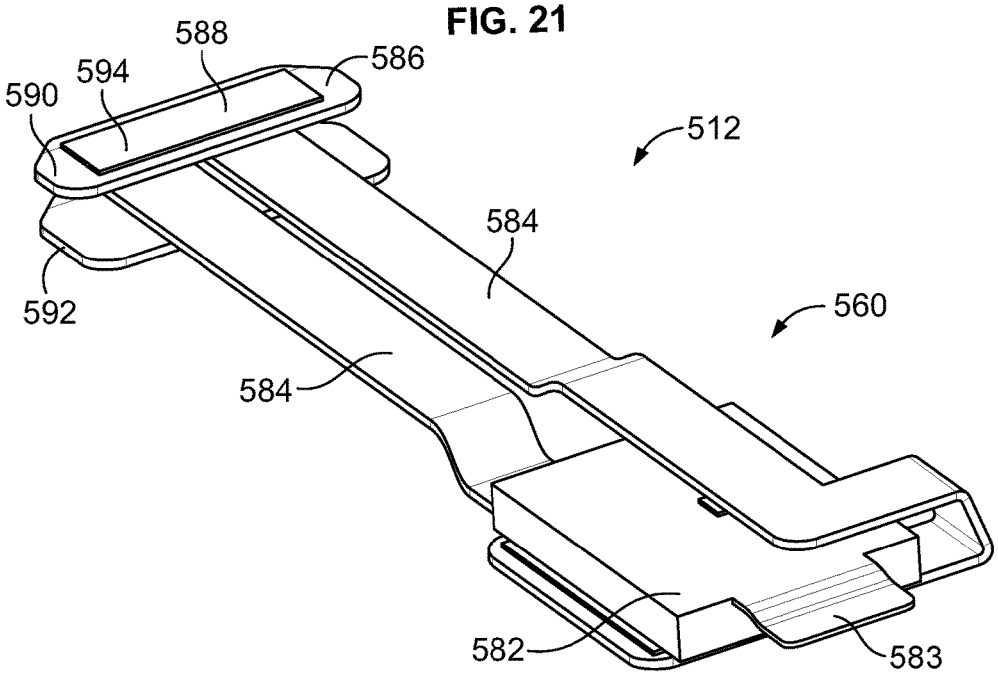
FIG. 22 is a perspective view of a portion of the power terminal shown in FIG. 20 in accordance with an exemplary embodiment.

FIG. 20 is a front perspective view of a portion of a power terminal 512 formed in accordance with an exemplary embodiment. FIG. 21 is a side view of a portion of the power terminal 512. FIG. 22 is a perspective view of a portion of the power terminal 512 in accordance with an exemplary embodiment. The power terminal 512 is similar to the power terminals 112, 312, 412 and may be used in the power connector system 100 in place of the power terminals 112, 312, 412 for mating with the mating power terminal 132. The power terminal 512 includes upper and lower or first and second terminal beams 570, 572, which may be similar to the terminal beams 170, 172. In the illustrated embodiment, the terminal beams 570, 572 are stamped and formed beams configured to extend from the terminating end to the mating end of the power terminal 512. The contact pad portions of the terminal beams 570, 572 are integral with the crimp barrel portions of the terminal beams 570, 572, as opposed to being separate components electrically coupled together as with the terminal beams 170, 172.

The power terminal 512 includes a protective thermal coupler (PTC) 560 for providing arc suppression. The PTC 560 includes a protective thermal coupler bridge 580 positioned adjacent the terminal beam 570 and/or 572 and a variable resistive member 582 (FIGS. 20 and 22) configured to be electrically coupled between the terminal beam 570 and/or 572 and the protective thermal coupler bridge 580. The variable resistive member 582 may be electrically connected to the terminal beam 570 and/or 572, such as by a spring beam 583 or another type of electrical connection. The protective thermal coupler bridge 580 may be similar to the protective thermal coupler bridges 380, 480. The protective thermal coupler bridge 580 includes a flexible polymeric film as an insulating coating layer around traces or conductors. The variable resistive member 582 may be similar to the variable resistive member 182 and/or 382 and/or 482. In an exemplary embodiment, the protective thermal coupler bridge 580 is at least partially arranged between the terminal beams 570, 572. For example, the protective thermal coupler bridge 580 and the terminal beams 570, 572 may be arranged in a layered or stacked arrangement to define a single male type terminal, such as a blade type terminal, configured to be mated with the mating power terminal 132.

The protective thermal coupler bridge 580 and the variable resistive member 582 define the shunt path through the power terminal 512 for arc suppression. The protective thermal coupler bridge 580 and the variable resistive member 582 are configured to be disconnected from the mating power terminal 132 after the main terminal beams 570, 572 are disconnected. The variable resistive member 582 is configured to vary resistance from a low resistance state to a high resistance state to operate as a switch to reduce the flow of current through the PTC 560. Optionally, the variable resistive member 582 may vary resistance with temperature. In an exemplary embodiment, the variable resistive member 582 creates a variable resistance path between the mating power terminal 132 and the terminal beams 570, 572.

The protective thermal coupler bridge 580 has at least one bridge conductor 584, at least one insulating substrate 586 and at least one bridge pad 588. The bridge conductors 584 may be laterally offset (FIG. 22) such that the bridge conductors 584 may be coplanar (FIG. 21). The bridge conductors may extend along both the top and the bottom of the variable resistive member 582. The protective thermal coupler bridge 580 may be a layered structure. For example, in the illustrated embodiment, the bridge conductor 584 and the bridge pads 588 are printed circuits on the insulating substrate 586 or conductors embedded in an insulating coating layer. The bridge conductor 584 may be exposed for electrical connection with the variable resistive member 582. The insulating substrate 586 may be a polymeric film. The insulating substrate 586 may be flexible.

In an exemplary embodiment, the protective thermal coupler bridge 580 includes upper and lower bridge members 590, 592, each having corresponding upper and lower bridge pads 594, 596. The ends of the bridge members 590, 592 are folded over the ends of the terminal beams 570, 572 and exposed on the upper and lower surfaces of the terminal beams 570, 572 for electrical connection with the mating power terminal 132 during mating and unmating. The bridge pads 594, 596 are exposed on both the top and bottom of the power terminal 512. In an exemplary embodiment, the bridge pads 594, 596 are staggered and thus axially offset to provide sequenced mating and unmating. The bridge pads 594, 596 also provide sequenced mating and unmating with the terminal beams 570, 572.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A power terminal for an electrical connector configured to be mated with a mating power terminal of a mating electrical connector, the power terminal comprising:

a terminal beam configured to be electrically coupled to a power wire, the terminal beam having a mating surface configured to be mated with the mating power terminal;

a protective thermal coupler bridge positioned adjacent the terminal beam, the protective thermal coupler bridge having a bridge conductor, an insulating substrate and a bridge pad, the bridge conductor provided on the insulating substrate, the bridge pad provided on the insulating substrate and being electrically coupled to the bridge conductor, the bridge pad having a mating surface configured to be mated with the mating power terminal; and a variable resistive member electrically coupled between the terminal beam and the bridge conductor, the variable resistive member providing a shunt so that arcing does not occur when the power terminal is disconnected from the mating power terminal of the mating electrical connector;

wherein the mating surface of the terminal beam is separable from the mating power terminal of the mating electrical connector before the mating surface of the bridge pad is disconnected from the mating power terminal of the mating electrical connector so that the resistance in the variable resistive member increases after disconnection of the power terminal from the mating power terminal and prior to disconnection of the bridge pad from the mating power terminal to shunt the current through the bridge conductor and the variable resistive member during unmating.

2. The power terminal of claim 1, wherein the mating surface of the terminal beam is aligned with the mating surface of the bridge pad along a mating axis of the power terminal with the mating power terminal.

3. The power terminal of claim 1, wherein the insulating substrate is positioned between the bridge conductor and the terminal beam.

4. The power terminal of claim 1, wherein the variable resistive member is directly coupled to the bridge conductor.

5. The power terminal of claim 1, wherein the variable resistive member includes a variable resistive member contact including a spring beam spring biased against the terminal beam to electrically couple the variable resistive member and the terminal beam.

6. The power terminal of claim 1, wherein the terminal beam includes a pocket therethrough, the protective thermal coupler bridge being provided at a bottom of the pocket, the variable resistive member being received in the pocket to engage the protective thermal coupler bridge.

7. The power terminal of claim 1, wherein the protective thermal coupler bridge comprises a printed circuit board having at least one internal conductive layer defining the bridge conductor and at least one external conductive layer defining the bridge pad with at least one internal insulating layer defining the insulating substrate.

8. The power terminal of claim 1, wherein the bridge conductor and the bridge pad are plated layers on the insulating substrate.

9. The power terminal of claim 1, wherein the insulating substrate is a flexible polymeric film, the bridge conductor and the bridge pad being circuit layers applied directly on the flexible polymeric film.

10. The power terminal of claim 1, wherein the terminal beam is a first terminal beam, the power terminal further comprising a second terminal beam configured to be electrically coupled to the power wire, the second terminal beam having a mating surface configured to be mated with the mating power terminal, the protective thermal coupler bridge being positioned between the first and second terminal beams in a stacked arrangement to define a single blade configured to be received in the mating power terminal.

11. The power terminal of claim 10, wherein the first terminal beam has a front edge, the second terminal beam having a front edge offset along a mating axis such that the second terminal beam is separable from the mating power terminal of the mating electrical connector before the first terminal beam separates from the mating power terminal.

12. The power terminal of claim 1, wherein the terminal beam is a first terminal beam, the insulating substrate is a first insulating substrate and the bridge pad is a first bridge pad, the power terminal further comprising a second terminal beam configured to be electrically coupled to the power wire, the second terminal beam having a mating surface configured to be mated with the mating power terminal, the protective thermal coupler bridge further comprising a second insulating substrate and a second bridge pad provided on the second insulating substrate forward of the second terminal beam, the first insulating substrate being positioned between and electrically isolating the first terminal beam and the bridge conductor, the second insulating substrate being positioned between and electrically isolating the second terminal beam and the bridge conductor.

13. The power terminal of claim 12, wherein the first terminal beam has a front edge positioned rearward of and separated from the first bridge pad by a first gap, the second terminal beam having a front edge positioned rearward of and separated from the second bridge pad by a second gap, the second gap being offset along a mating axis such that the second terminal beam is separable from the mating power terminal at the second gap while the first power terminal remains connected to the mating power terminal, the second bridge pad being connected to the mating power terminal while the first terminal beam is separated from the mating power terminal at the first gap.

14. The power terminal of claim 1, further comprising a dielectric cover covering the terminal beam and the protective thermal coupler bridge at the variable resistive member.

15. The power terminal of claim 1, wherein electrical resistance in the variable resistance member increases in response to increasing current to reduce the flow of current through the protective thermal coupler bridge before the protective thermal coupler bridge is disconnected from the mating power terminal of the mating electrical connector so that arcing does not occur when the terminal beam is disconnected initially causing an increase in the flow of current through the variable resistance member.

16. The power terminal of claim 1, wherein the variable resistance member comprises a conductive polymer member with conductive particles immersed in a nonconductive polymer, increased resistive heating causing the nonconductive polymer to expand to disrupt conductive paths formed by interconnected conductive particles.

17. The power terminal of claim 1, wherein the protective thermal coupler bridge is disconnected from the mating power terminal after a finite time interval from the disconnecting of the terminal beam from the mating power terminal of the mating electrical connector, the finite time interval being long enough for resistance in the variable resistive member to increase sufficiently to reduce the current through the protective thermal coupler bridge below an arcing threshold so that arcing does not occur upon disconnection of the protective thermal coupler bridge from the mating power terminal of the mating electrical connector.

18. The power terminal of claim 1, wherein the variable resistive member comprises a positive temperature coefficient resistive member characterized by a finite trip time to switch from a first relatively low resistance state to a second relatively higher resistance state.

19. The power terminal of claim 1, wherein the variable resistive member comprises a positive temperature coefficient resistive member, a resistance of the positive temperature coefficient resistor increases sufficiently rapidly between separation of the terminal beam and disconnection of the protective thermal coupler bridge so that the electrical energy flowing through the protective thermal coupler bridge is reduced below the arcing threshold after separation of the terminal beam and before disconnection of the protective thermal coupler bridge.

20. An electrical connector matable to and unmatable from a separable mating electrical connector, the electrical connector comprising:

a housing having a mating end and a wire end;

a power terminal received in and held by the housing, the power terminal being matable with and unmatable from a mating power terminal of the mating electrical connector, the power terminal comprising:

a terminal beam configured to be electrically coupled to a power wire extending from the wire end of the housing, the terminal beam having a mating surface configured to be mated with the mating power terminal;

a protective thermal coupler bridge positioned adjacent the terminal beam, the protective thermal coupler bridge having a bridge conductor, an insulating substrate and a bridge pad, the bridge conductor provided on the insulating substrate, the bridge pad provided on the insulating substrate and being electrically coupled to the bridge conductor, the bridge pad having a mating surface configured to be mated with the mating power terminal; and a variable resistive member electrically coupled between the terminal beam and the bridge conductor, the variable resistive member providing a shunt so that arcing does not occur when the power terminal is disconnected from the mating power terminal of the mating electrical connector;

wherein the mating surface of the terminal beam is separable from the mating power terminal of the mating electrical connector before the mating surface of the bridge pad is disconnected from the mating power terminal of the mating electrical connector so that the resistance in the variable resistive member increases after disconnection of the main power terminal from the mating power terminal and prior to disconnection of the bridge pad from the mating power terminal to shunt the current through the bridge conductor and the variable resistive member during unmating.

* * * * *